US008282018B2

(12) United States Patent
Kennard et al.

(10) Patent No.: US 8,282,018 B2
(45) Date of Patent: Oct. 9, 2012

(54) TRACK DEVICE

(75) Inventors: Christopher S. Kennard, Northridge, CA (US); Wayne Carmona, Beverly Hills, CA (US)

(73) Assignee: OSB, Inc., Studio City, CA (US)

( * ) Notice: Subject to any disclaimer, the term of this patent is extended or adjusted under 35 U.S.C. 154(b) by 296 days.

(21) Appl. No.: 12/824,210

(22) Filed: Jun. 27, 2010

(65) Prior Publication Data

US 2010/0301125 A1 Dec. 2, 2010

Related U.S. Application Data

(63) Continuation-in-part of application No. 11/279,545, filed on Apr. 12, 2006, now Pat. No. 7,770,810.

(60) Provisional application No. 60/671,245, filed on Apr. 12, 2005.

(51) Int. Cl.
*E01B 23/00* (2006.01)

(52) U.S. Cl. ..... 238/10 R

(58) Field of Classification Search ..... 285/399, 285/400, 397; 352/243; 104/126; 238/32, 238/33, 24, 122, 134, 143, 70, 10 R, 11, 12, 238/13

See application file for complete search history.

(56) References Cited

U.S. PATENT DOCUMENTS

| | | | | |
|---|---|---|---|---|
| 214,545 | A | 4/1879 | Bacon | |
| 2,984,853 | A | 6/1959 | Williams | |
| 3,406,993 | A | 10/1968 | Haynes | |
| 3,609,906 | A | 10/1971 | Johnson et al. | |
| 4,989,782 | A * | 2/1991 | McKie | 238/10 R |
| D376,460 | S * | 12/1996 | Isaia et al. | D34/28 |
| 5,711,227 | A | 1/1998 | Johnson | |
| 5,887,787 | A | 3/1999 | Saldana, III | |
| D409,348 | S | 5/1999 | McKie | |
| 6,423,388 | B1 | 7/2002 | Bateson et al. | |
| 6,435,421 | B1 | 8/2002 | Peterson | |
| 6,557,775 | B1 * | 5/2003 | Brinson et al. | 238/10 R |
| 7,770,810 | B2 * | 8/2010 | Kennard et al. | 238/10 R |
| 2006/0226248 | A1 | 10/2006 | Kennard et al. | |

* cited by examiner

*Primary Examiner* — Mark Le
(74) *Attorney, Agent, or Firm* — Paul D. Chancellor; Ocean Law

(57) ABSTRACT

Embodiments of a track device include a track section with a hollow rail, a rail support member with flanges, eccentric rail support, a cross member with a rotatably coupling, rail ferrules for mating, and rail materials including a lubricious material.

11 Claims, 10 Drawing Sheets

TRACK DEVICE

PRIORITY CLAIM

This application is a continuation-in-part of U.S. patent application Ser. No. 11/279,545 filed Apr. 12, 2006, now U.S. Pat. No. 7,770,810, which claims the benefit of U.S. Provisional Pat. App. No. 60/671,245 filed Apr. 12, 2005.

INCORPORATION BY REFERENCE

This application incorporates by reference U.S. patent application Ser. No. 11/279,545 filed Apr. 12, 2006 and U.S. Provisional Pat. App. No. 60/671,245 filed Apr. 12, 2005 in their entireties and for all purposes. In particular, this incorporation includes the track device disclosed by these patent applications.

BACKGROUND OF THE INVENTION

1. Field of the Invention

The present invention relates to a track device. In particular, a track device including a rail and a cross-member for supporting wheeled carriage.

2. Discussion Of The Related Art

Track devices are known for supporting wheeled carriages. For example, motion picture crews use cameras mounted on a wheeled dolly for certain shots. The wheeled dolly travels on a track, similar to a train track in that it includes rails and cross members.

Dolly track may be rented instead of owned. Not all shots require a dolly mounted camera so it is often useful to rent dollies and dolly track only for scenes or shoots that require it. Because of this, rental track is often mishandled and damaged during transport and use. Even when owned, dolly track is susceptible to wear and damage during use. This is a problem because an important aspect of the dolly track is to provide a smooth surface for moving the camera during the shot. Imperfections in the dolly track can result in unwanted vibrations in the camera, degrading the camera shot. Because dolly track is comprised of track sections, there are section joints having the potential for creating an uneven track surface and a bumpy dolly ride that can shake the camera during use. Dolly wheels traveling over uneven surfaces can also create unwanted noise that is included in the scene being recorded.

There are a number of disadvantages of prior art track systems. One disadvantage is that it is not possible to carry joined sections of track without damaging the track and increasing the likelihood of poor joint performance. This requires completely disassembling all track pieces when the track is to be moved. This is a time consuming process and adds to the cost of filmmaking. Another disadvantage of prior art track systems is the changing performance with changing temperature. Another disadvantage of prior art tube tracks is the method used for joining the track sections. The methods used often result in a poor joint that interrupts the desired smooth surface of track. Another disadvantage is that metal tracks are easily bent and/or dented so as to make them unsuitable for use.

SUMMARY OF THE INVENTION

A track device includes rails and cross-members for supporting a carriage with wheels such as a car, dolly or cart.

In an embodiment, the track device provides a smooth, low noise dolly movement comprising the steps of providing first and second track sections, each section including first and second hollow rails; providing for each rail a respective support member including a hollow part and opposed flanges; continuously and eccentrically supporting each rail with the hollow part; spacing the support members apart with a plurality of cross members, each cross member having opposed ends and each end rotatably coupled between opposed flanges of a rail support member; providing a male conical ferrule at one end of each rail and a female conical ferrule at the opposite end of each rail tube, rail ends at the end of the same track section having one male ferrule and one female ferrule; providing adjacent to each mated ferrule pair a buckle with a lever operated latch and a slotted latch plate affixed to the hollow part; mating the male and female ferrules at one end of the first track section with the female and male ferrules at one end of the second track section; drawing the mated ferrules together by hooking the latch in the slotted latch plate and rotating the lever to close the buckle; limiting dolly bumps by matching the rail outer diameter with the ferrule outer diameter where the rail abuts the ferrule; and, limiting dolly noise by selecting a rail material and a mating dolly wheel material that produce a lubricious wear byproduct during use.

In various embodiments, the method further comprises one or more of the step of providing an uncoated carbon fiber composite rail and wherein the lubricious wear byproduct is a material containing carbon and the step of providing access to a cavity of the hollow part via the latch plate slot and wherein hooking the latch in the slotted latch plate results in the latch protruding into the hollow part cavity.

In an embodiment a track device comprises first and second hollow rail tubes coupled to respective support members and at least one cross member interconnecting the support members; each support member including a hollow part and two flanges; the hollow part extending along the length of a respective rail tube; the flanges extending along the majority of the length of a respective rail tube; the hollow part including a first side formed to match the curvature of a selected outer circumference of a rail tube; the first side of the hollow part supporting the rail tube; the hollow part including a second side, the flanges extending from the second side with a gap therebetween; the hollow part including a third side for supporting the rail tube; the cross member having opposed ends; an end of the cross member having an uncurved corner substantially opposite a curved corner; the cross member end inserted in the gap of the first support member and rotatably coupled to the flanges forming the gap; the track having collapsed and extended states; in the extended state, the cross member extends between the support members with the cross member ends located in the respective gaps; and, in the extended state, an uncurved corner limits rotation of the cross member with respect to a support member in one direction.

In various embodiments, the device includes one or more features wherein in the collapsed state a lengthwise edge of the cross member is located mostly between the flanges of a support member; wherein in the collapsed state an end of the cross member is mostly located in a pocket created by opposing flanges of adjacent support members; further comprising a rail tube circumference about evenly divisible into four consecutive quadrants, the first quadrant meeting the fourth quadrant at a top of the rail tube for supporting dolly wheels; wherein the selected outer circumference of one rail tube is substantially included in the third quadrant of the rail tube circumference; further comprising a fourth side of the hollow part; and, wherein the second and fourth sides of the hollow part support the rail tube.

In various embodiments, the device includes a buckle for drawing adjacent track assemblies together; the buckle including clevis, a lever, a pawl, and a fastener; the lever rotatably engaged with the clevis; the pawl rotatably engaged with the lever; and, the pawl operable to restrain the lever when a midsection of the pawl is held by the fastener.

In an embodiment the track assembly comprises first and second self-lubricating, hollow rail tubes coupled to respective support members and at least one articulated cross member interconnecting the support members; each support member including a hollow part and two flanges; the hollow part including a first side formed to match the curvature of a selected outer circumference of a rail tube; the first side of the hollow part supporting the rail tube; the hollow part including a second side, the flanges extending from the second side with a gap therebetween; the hollow part including a third side for supporting the track; the cross member having opposed ends; an end of the cross member having an uncurved corner substantially opposite a curved corner; the cross member end inserted in the gap of the first support member and rotatably coupled to the flanges forming the gap; the track having collapsed and extended states; in the extended state, the cross member extends between the support members with only the cross member ends located in the respective gaps; and, in the extended state, an uncurved corner limits rotation of the cross member with respect to a support member in one direction.

In an embodiment the track assembly comprises first and second hollow rails; first and second support members coupled to the first and second rails to support the first and second rails; each support member including a hollow part and two opposed flanges; the hollow part including a first side formed to match the curvature of a selected outer circumference of a rail tube; the first side of the hollow part supporting the rail tube; the hollow part including a second side, the flanges extending from the second side with a gap therebetween; a cross member having first and second opposed ends, the first end pivotally coupled between the flanges of the first support member and the second end pivotally coupled between the flanges of the second support member; a first buckle mounted at the end of the first support member for engaging a mating fastener mounted at the end of an opposed support member; the buckle including a clevis, a lever, a pawl, and a fastener wherein the lever is rotatably engaged with the clevis, the pawl is rotatably engaged with the lever and the pawl is operable to restrain the lever when a midsection of the pawl is captured by the fastener; the track having collapsed and extended states; and in the collapsed state an edge of a cross member is substantially located in a pocket created by opposing flanges of one support member.

BRIEF DESCRIPTION OF THE DRAWINGS

The present invention is described with reference to the accompanying figures. These figures, incorporated herein and forming part of the specification, illustrate the present invention and, together with the description, further serve to explain the principles of the invention and to enable a person skilled in the relevant art to make and use the invention.

DETAILED DESCRIPTION OF THE PREFERRED EMBODIMENTS

The disclosure provided in the following pages describes examples of some embodiments of the invention. The designs, figures, and description are non-limiting examples of certain embodiments of the invention. For example, other embodiments of the disclosed systems and methods may or may not include the features described herein. Moreover, disclosed advantages and benefits may apply to only certain embodiments of the invention and should be not used to limit the disclosed inventions.

In the following description of the invention, reference is made to the accompanying drawings that form a part hereof, and in which is shown by way of illustration a specific embodiment in which the invention may be practiced. It is to be understood that other embodiments may be utilized and structural changes may be made without departing from the scope and spirit of the invention.

The invention provides a light and strong carriage track such as a dolly track comprised of one or more light and strong polymers, metals and composites. Exemplary materials include carbon fiber, fiberglass, carbon fiber composites, fiberglass composites and hybrid composites including one or both of carbon fiber and fiberglass. Carbon fiber track material is preferred. The material has memory properties such that even with moderate overloads it does not permanently deform but tends to return to its true shape each time. It has a very low thermal reactivity so that the track has consistent performance over a wide range of operating temperatures.

Figure 1:
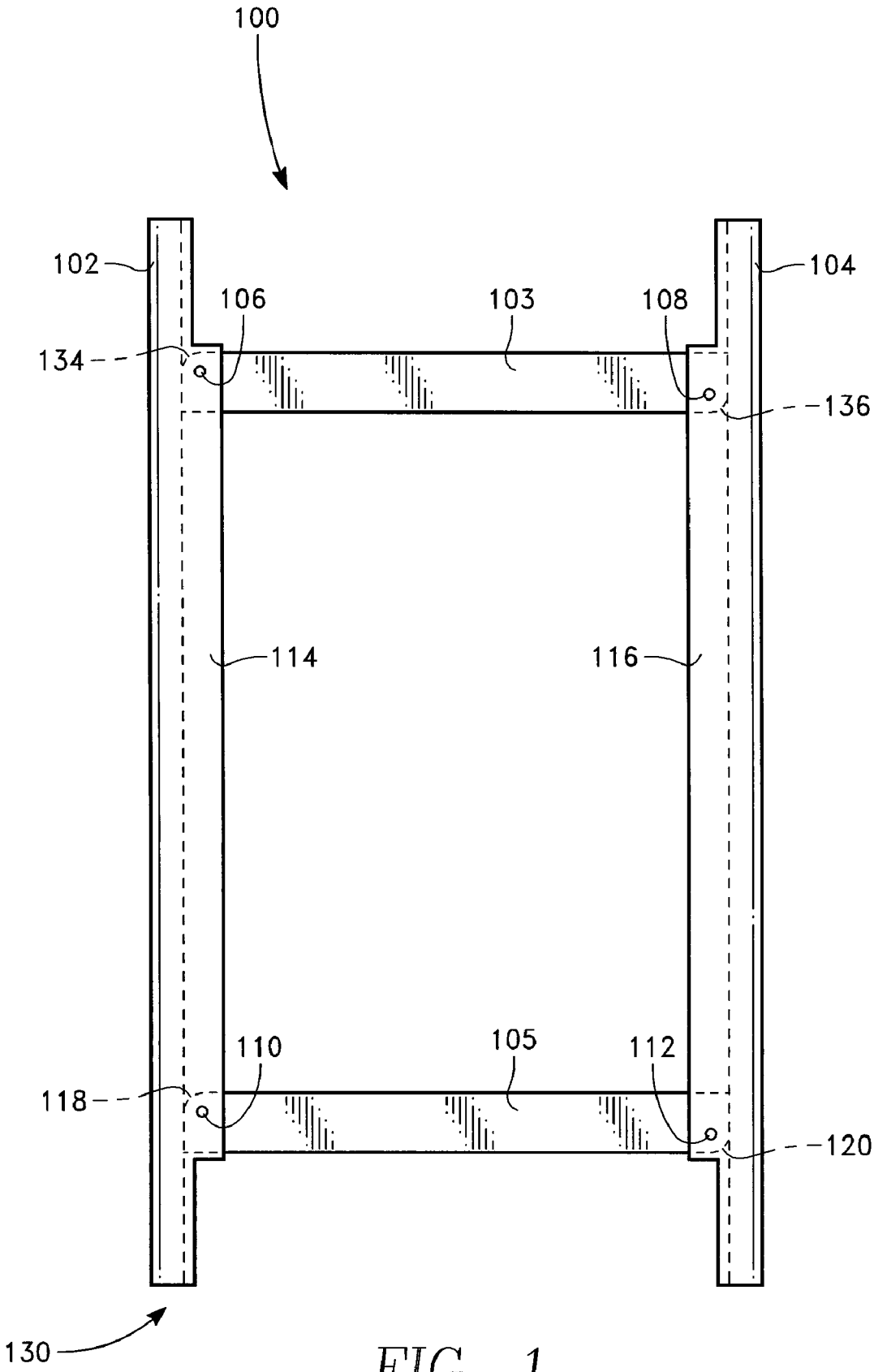
FIG. 1 is a top view of a track section in accordance with the present invention.

FIG. 1 shows a top view of a collapsible track section made in accordance with the present invention 100. The track section includes first and second rail tubes 102, 104 with respective rail tube supports 114, 116 and first and second cross members 103, 105. As shown here, the rail tubes are fully separated by the cross members. The first cross member is pivotally coupled to the first and second rail tube supports via first pivotal couplings 106, 108 and the second cross member is pivotally coupled to the first and second rail tube supports via second pivotal couplings 110, 112. In an embodiment, a pair of diagonal corners of the first cross member 134, 136 and a pair of diagonal corners of the second cross member 118, 120 are curved.

As will be understood by persons of ordinary skill in the art, embodiments of the track device include track sections having more than two cross-members. For example, in various embodiments, a single section of track has three, four, five, or more cross members.

Figure 2:
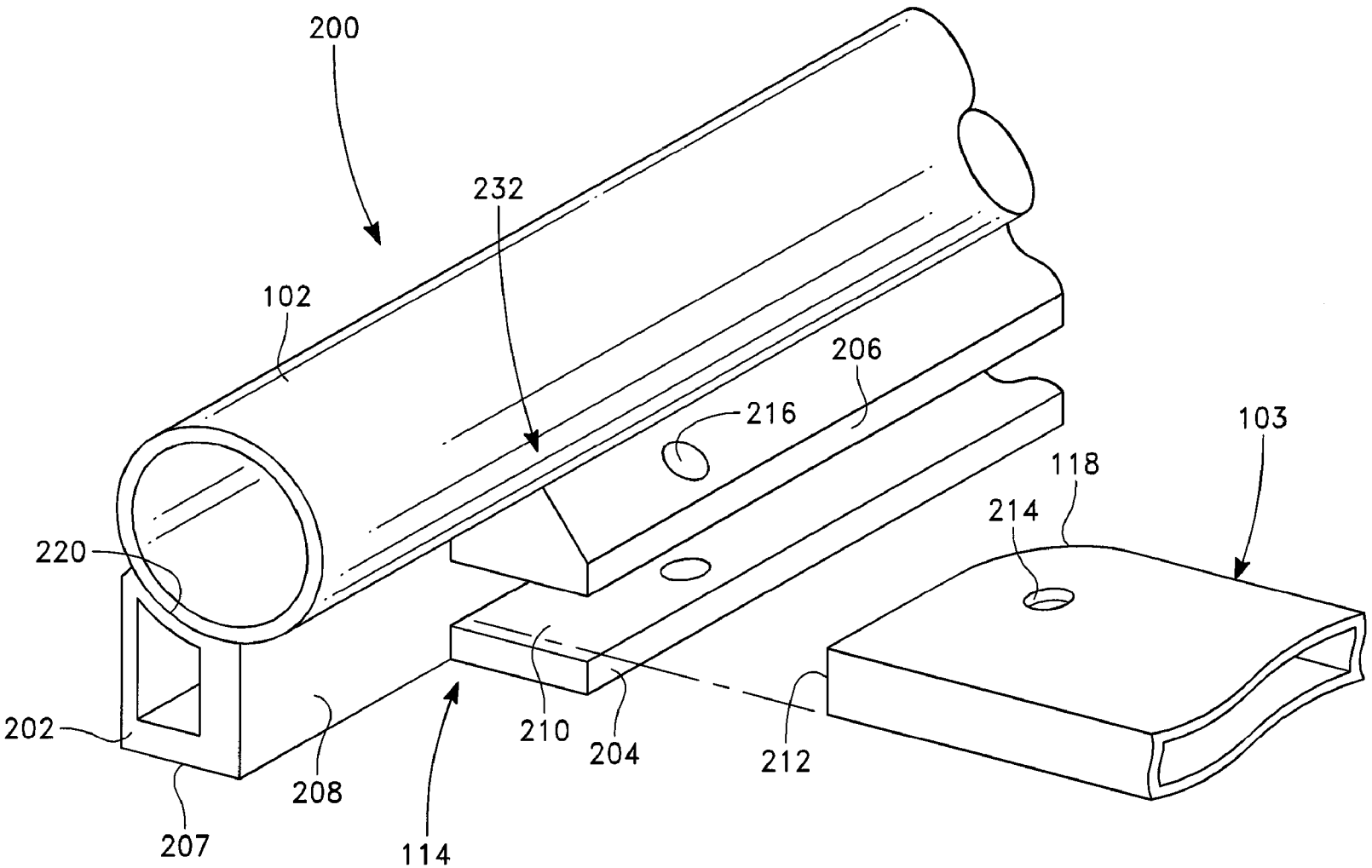
FIG. 2 is a perspective end view of a rail tube and support and a detached cross member of the track section of FIG. 1.

FIG. 2 shows a perspective end view 130 of a rail tube and support and a detached cross member 200. In an embodiment, the rail tube 102 is generally circular in cross-section and hollow; in various other embodiments, the rail tube has one or more of a curved cross-section, a cross-section with linear portions, and a filled cross-section.

In an embodiment, the rail tube supports 114, 116 include a box section 202 with an inner side-wall 208, and upper and lower flanges 206, 204 defining a flange gap 210 therebetween. In some embodiments, the box section has a support surface 207 substantially opposite a curved surface 220 for mating with the rail tube. And, in an embodiment, the rail tube support box is a hollow part and in an embodiment, the rail tube support box is filled. In an embodiment, the hollow part substantially continuously supports the rail tube. And, in an embodiment, the hollow part substantially eccentrically supports the rail tube.

In some embodiments selected surfaces of the track section are coated with a suitable anti-slip coating known to persons of ordinary skill in the art such as an elastomeric coating including one or more of natural materials or rubbers, synthetic materials or rubbers, styrene butadiene, neoprene, butyl rubbers, isoprene, nitrile elastomers/NBR rubbers, polybutadiene elastomers, ethylene-propylene elastomers, urethanes, fluorocarbon elastomers, Rhino brand coatings, RhinoTech brand coatings, and the like. In various embodiments, one or more of the track's lower surfaces 207, 530, 532, 507 are coated with an anti-slip coating.

A detached cross member 103 is shown alongside the rail tube support 114 and an end of the cross member 212 is for insertion in the flange gap 210. A pivotal coupling 110 rotatably fixes the end of the cross member within the flange gap. In an embodiment, the pivotal coupling is provided by aligned holes in the cross member and support structure 214, 216 with a pin (not shown for clarity) inserted therethrough. As will be appreciated by persons of ordinary skill in the art, the curved corner of the cross member 118 enables the curved corner to rotate past the box section inner side wall 208 while the uncurved corner of the cross member prevents the uncurved corner from rotating past the box section side wall.

In an embodiment, the rail tube support 114 and the rail tube 102 are an integral structure. And, in various embodiments, the rail tube support 114 is an integral structure. In various embodiments the rail tube support is a structure made from plural parts. For example, the box section 202 and flanges 204, 206 may be formed as a single structure or the box section and one or more flanges may be formed as multiple structures. Where needed, the rail tube support is fixed to the rail tube 102 by a suitable means such as by an adhesive fixing the rail tube to a mating curved surface of the box section 220.

In an embodiment, rail tube 102, rail tube support 114, and cross member 103 materials of construction include one or both of glass fibers and carbon fibers in a matrix such as epoxy, polyester or vinyl ester. In some embodiments, the rail tubes are formed from layers of carbon fiber that are pre-impregnated. The pre-impregnated fiber method provides stiff, strong laminates with controllable, predictable results adapted to provide adequate resistance to crushing from dolly wheel loads (hoop strength) and adequate stiffness to prevent excessive bending of unsupported lengths such as when the track is lifted and/or moved. And, in some embodiments, carbon fiber rail tubes are designed to expose the carbon fibers at the outer surface of the tube, the exposed carbon fibers providing a ready source of lubricating itself and, for example, tending to reduce the noise of wheel/rail interactions. Notably, the surface coatings normally applied for carbon fiber composite surface protection are not used in this embodiment.

For example, carbon fiber is pre-impregnated with resin, rolled on spools, and frozen to prevent the resin from curing prematurely. This material is cut and laid using a rail tube mold or mandrel to the proper thickness and cured, such as by one or more of vacuum bag compaction, heating, and pressurizing. In an embodiment, the rail tubes 102 are formed from pre-impregnated carbon fiber tape and the finished tube is not coated; rather, the tube surface 232 is left uncoated such that carbon at the surface of the tube provides a natural lubricant tending to reduce noise created by tube/dolly wheel interactions.

In an embodiment, the cross members are made from fiberglass. And, in some embodiments, the cross members are made from glass fibers and carbon fibers in an epoxy matrix. In an embodiment, the tube support is made from fiberglass. And, in some embodiments, the tube support is made from glass fibers and carbon fibers in an epoxy matrix.

In some embodiments, the rail tube 102 surface material and the material of wheels, such as dolly wheels, is chosen to produce a wear by product that lubricates the surface of the rail. For example, an uncoated carbon fiber composite rail tube will be worn by a dolly wheel of a metal or similar hard material such as steel, iron, cast iron, aluminum and other materials known to persons of ordinary skill in the art. In like manner, a wheel with an uncoated carbon fiber composite running surface will be worn by a sufficiently hard rail. Notably, initial use of new parts results in a lubricious wear byproduct. There is no requirement, for example, to wait until wear removes outer coatings and the like to expose lubricious material such as carbon fiber.

Figure 3B:
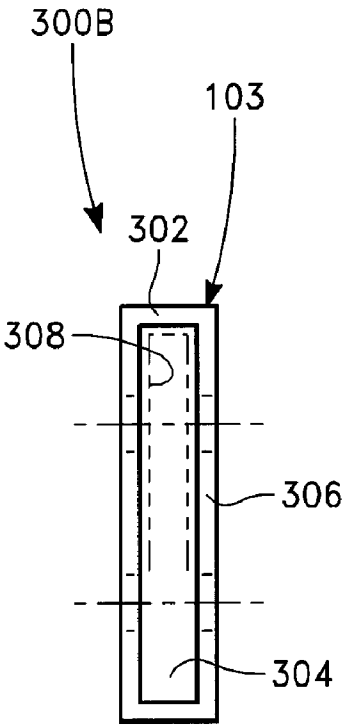
FIGS. 3A-B are top and cross-sectional views of a cross member of the track section of FIG. 1.
Figure 3A:
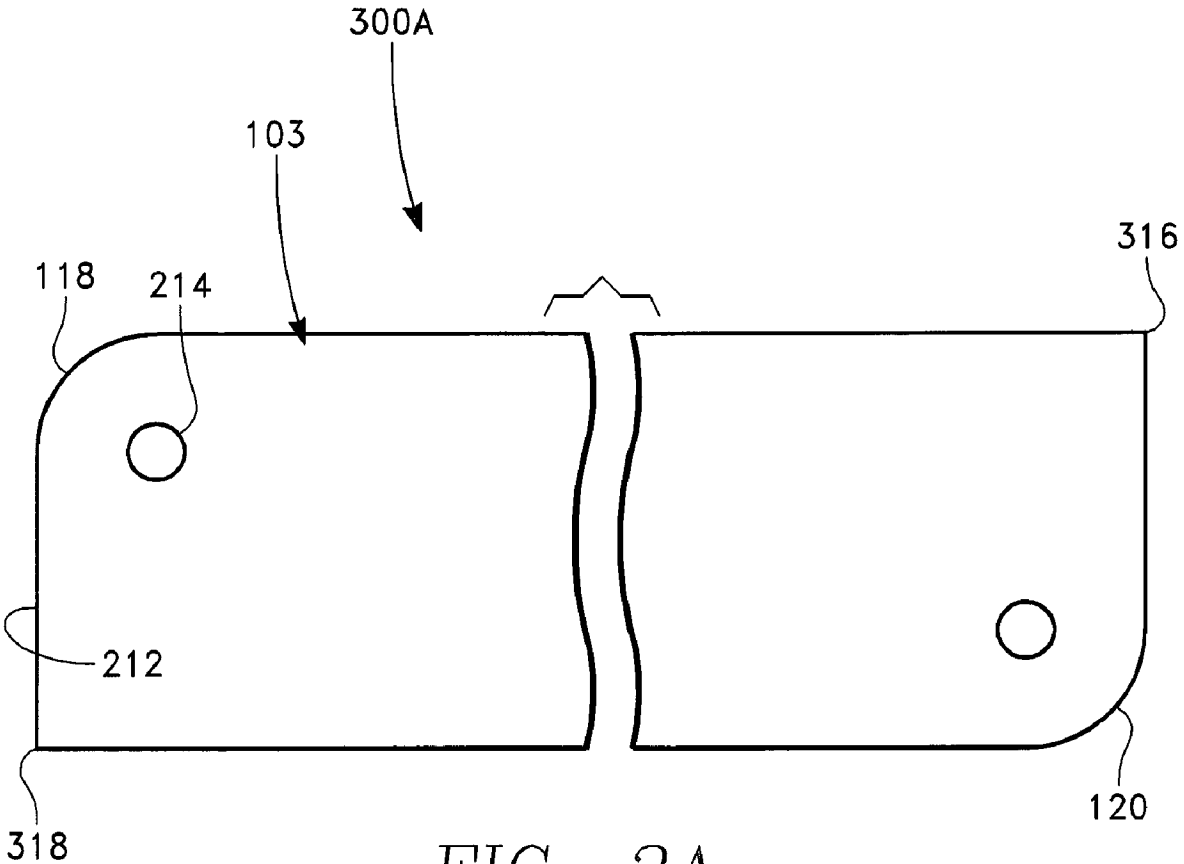

FIGS. 3A-B show a typical cross member of an embodiment of the invention 300A, 300B. The cross member includes a first curved corner 118 adjacent to a first uncurved corner 318 and a second curved corner 120 adjacent to a second uncurved corner 316. The cross member's cross-section shown in FIG. 3B illustrates a hollow embodiment of the cross member having an outer wall 306. Notably, in some embodiments the cross member has a wall 302 surrounding a cavity 304. And, in some embodiments, an anti-friction insert 308 such as a nylon insert provides a bedding for pins or similar members for rotatably coupling the cross member to the support structure 114.

Figure 4:
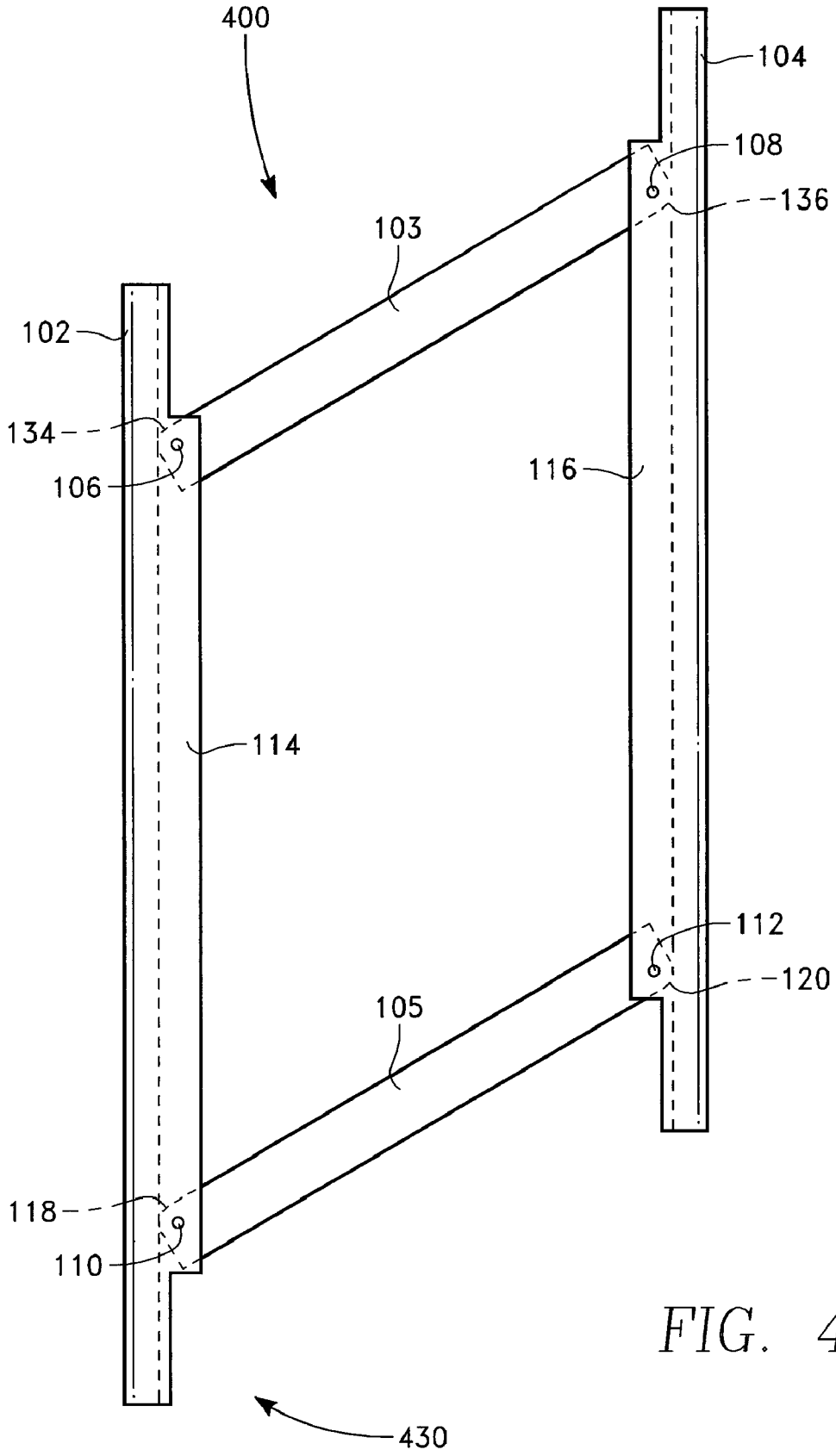
FIG. 4 is a top view of the track section of FIG. 1 that is partially collapsed.

FIG. 4 shows a section of the track device that is partially collapsed 400. As can be seen, the track section collapses when the cross members are rotated with respect to the rail tube supports 114, 116 such that the rounded ends of the first cross member 134, 136 and the rounded ends of the second cross member 118, 120 pass by the box section inner side-wall 208. As persons of ordinary skill in the art will recognize, the curved and uncurved corners of the cross members can be reversed while providing substantially the same collapsible functionality.

In the embodiment shown, during collapsing the cross members rotate in a anti-clockwise direction with respect to the rail tube supports. In some embodiments, this rotation is stopped when the cross members are about parallel with the rail supports. Similarly, during separation, the cross members rotate in the opposite direction and in some embodiments this rotation is stopped when the cross members are about perpendicular with the rail tube supports.

Figure 5:
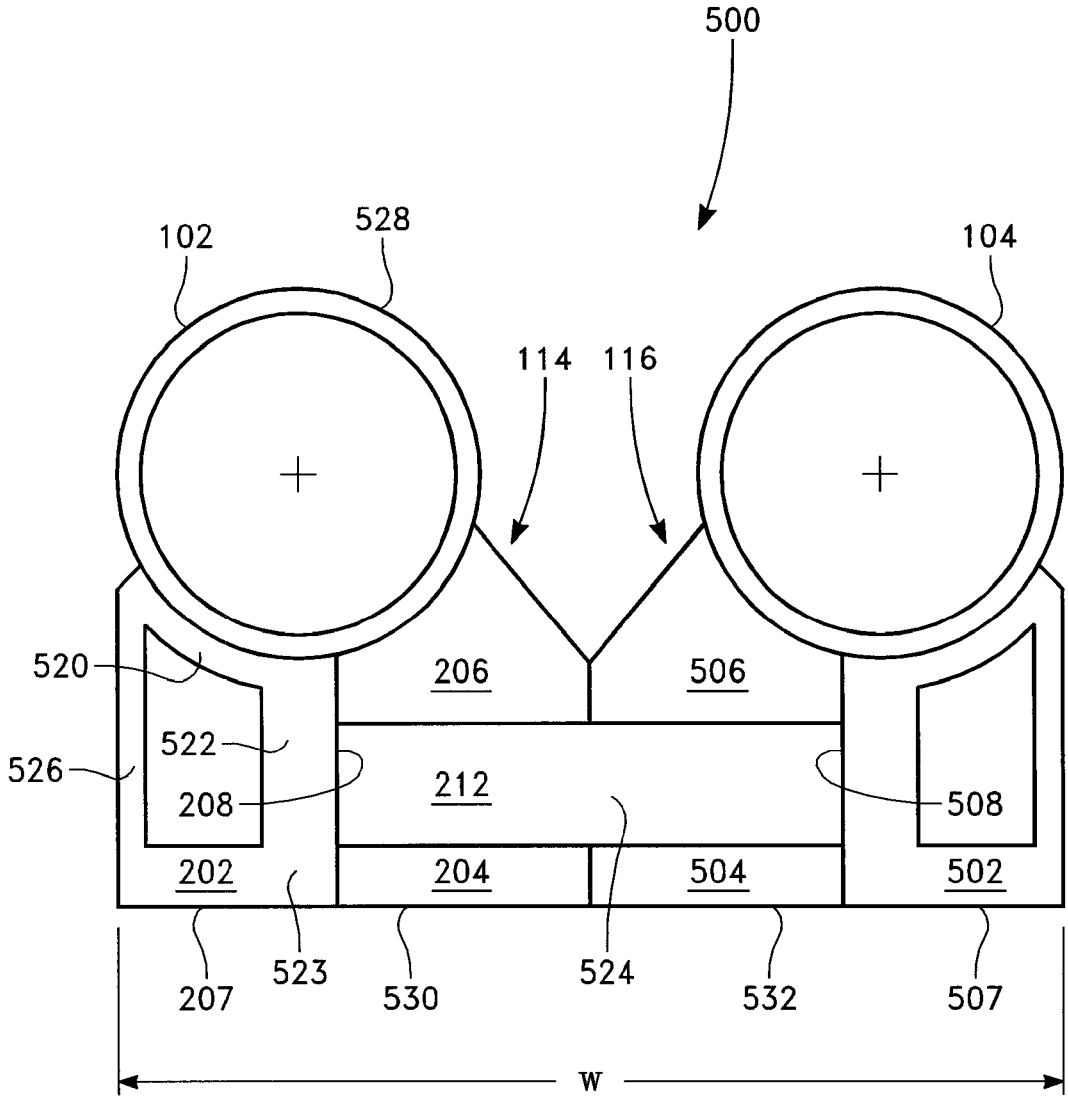
FIG. 5 is an end view of the track section of FIG. 1 that is fully collapsed.

FIG. 5 shows an end view 430 of a collapsed track section 500. Similar to FIG. 2, a rail tube 104 is supported by a rail tube support 116 including an upper flange 506, a lower flange 504, and a box section 502 having a box section support surface 507 and a box section inner side-wall 508.

In an embodiment, each rail tube support 114, 116 includes a hollow part 202 with two flanges 204-6, 504-6. Here, the hollow part includes a first side formed to match the curvature of a selected outer circumference of a rail tube 520, the first side of the hollow part supports the rail tube, the hollow part includes a second side 522, the flanges extend from the second side with a gap 524 therebetween, and the hollow part includes a third side 523 for supporting the track. And, in some embodiments, a rail tube circumference is about evenly divisible into four consecutive quadrants, the first quadrant meeting the fourth quadrant at a top of the rail tube 528 for supporting dolly wheels, a selected outer circumference of one rail tube is substantially included in the third quadrant of the rail tube circumference, the hollow part has a fourth side 526, and second and fourth sides of the hollow part support the rail tube.

As can be seen, collapsing the track section narrows the width "w" of the track section as the rail tube support sections 114, 116 move closer together. And, in some embodiments, collapsing the track section causes one or more of abutment of the rail tube support upper flanges 206, 506 (as shown) and abutment of the rail tube support lower flanges 204, 504 (as shown).

Figure 6:
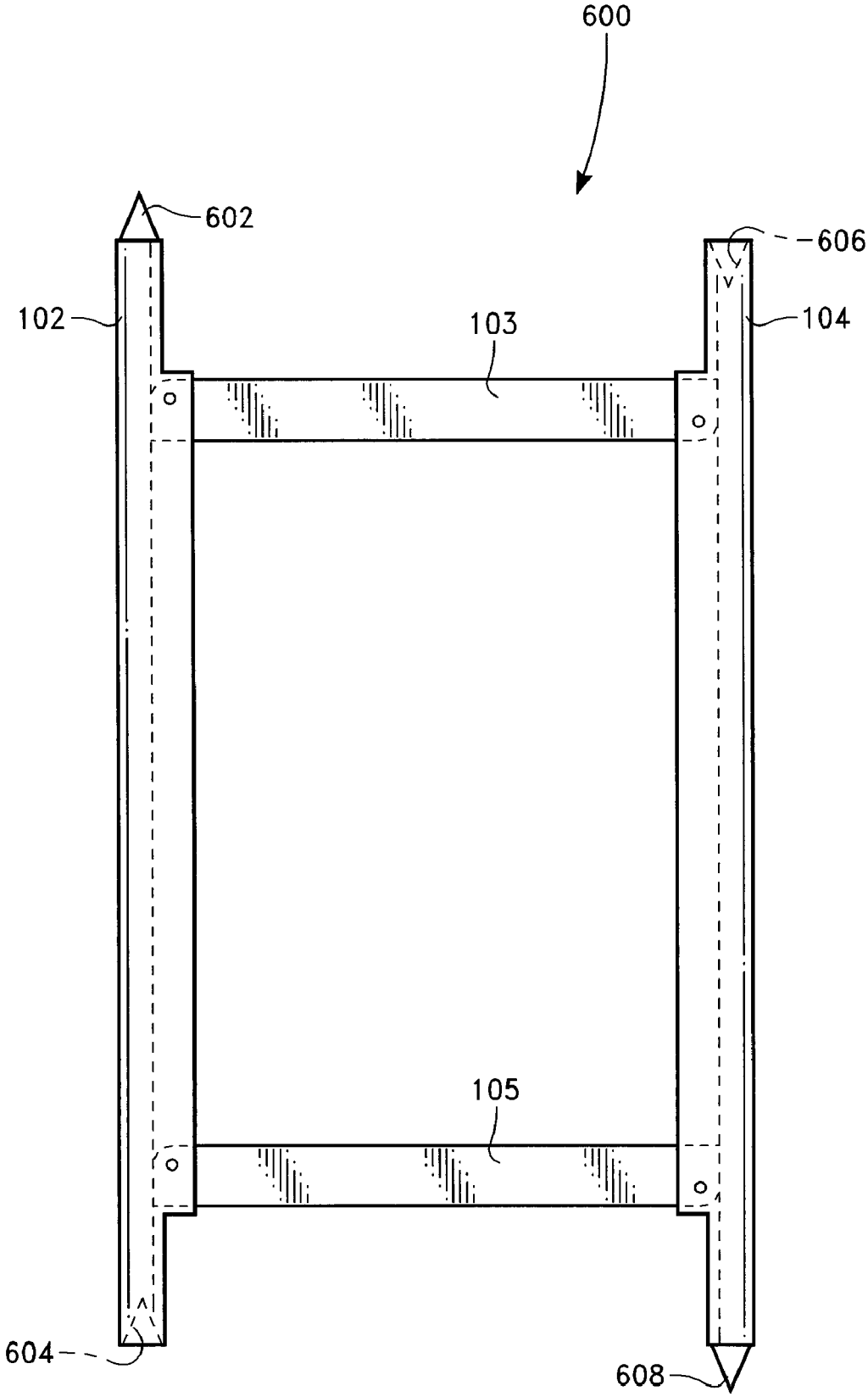
FIG. 6 is a top view of the track section of FIG. 1 that includes ferrules.

FIG. 6 shows a top view of a track section with ferrules 600. Male ferrules 602, 608 are located at first opposed ends of the rail tubes 102, 104 and female ferrules 604, 606 are located at second opposed ends of rail tubes 102, 104. As persons of ordinary skill in the art will recognize, the location of the male and female ferrules can be reversed while providing substantially the same joint functionality.

Figure 7:
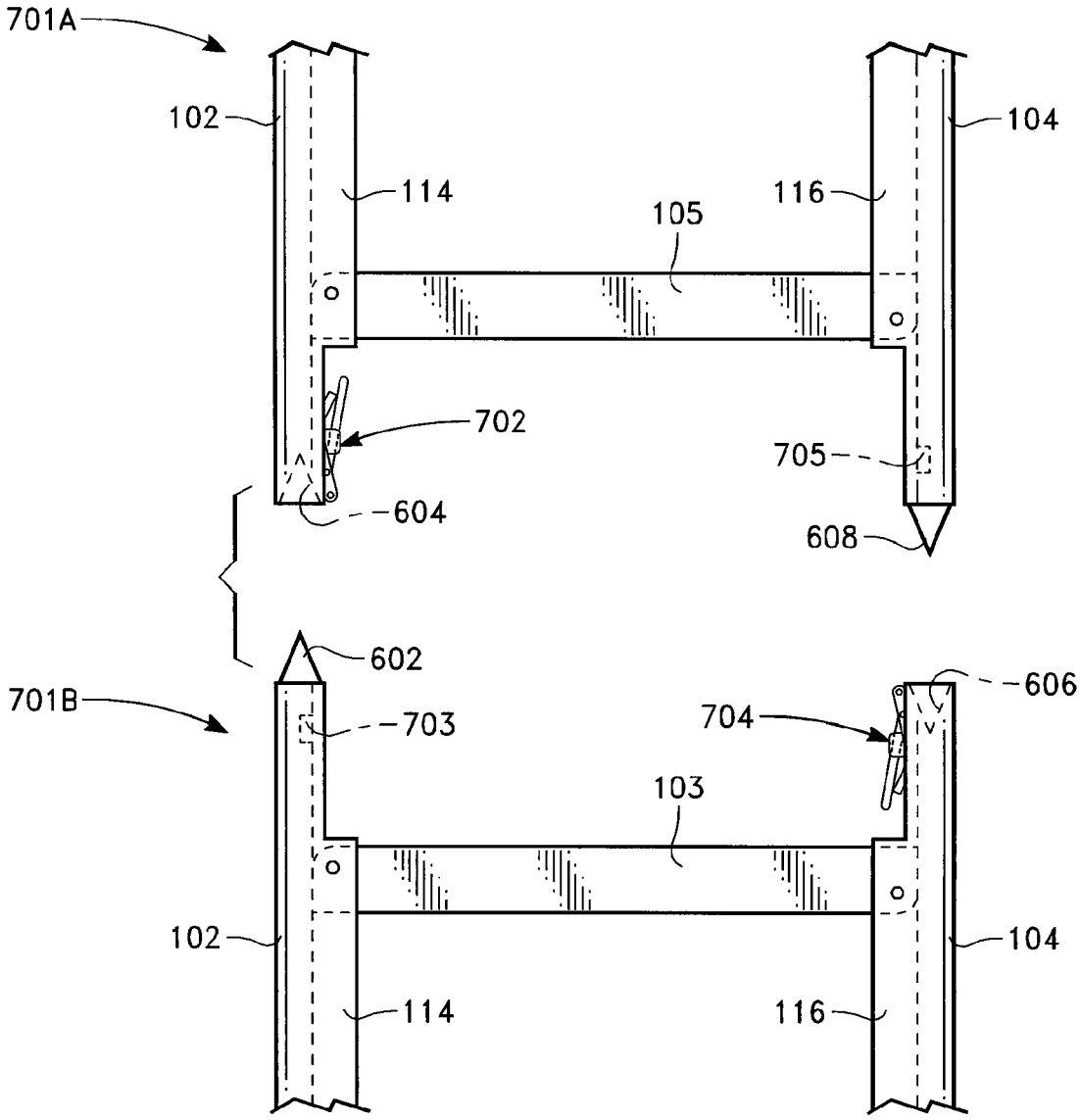
FIG. 7 is a top view of adjoining track sections of FIG. 1.

FIG. 7 shows a top view of adjoining track sections 701A, 701B. In the embodiment shown, the track sections are mated when the male and female ferrules at the end of the first track section 602, 606 mate with corresponding female and male ferrules at the adjoining end of a second track section 604, 608.

The ferrules 602, 606 and the ferrules 604, 608 are held in close mating relationship by one or more fasteners such as buckles, latches. In some embodiments, each track section has a plurality of buckles 702, 704 for holding the ferrules in close mating relationship. And, in some embodiments the buckles are fixed to the inner side-walls of the rail tube supports 208. Buckle attachments are located opposite the buckle on the adjoining track section. In an embodiment, the buckle attachment is in the form of a post and, in an embodiment, the buckle attachment is in the form of a pocket such as a pocket in an inner side wall of the rail tube support 703, 705.

Figure 8A:
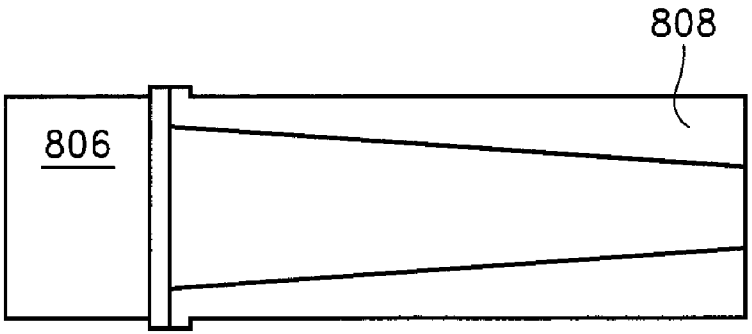
FIGS. 8A-C show cross-sectional schematic views of ferrules for use with the track section of FIG. 1.
Figure 8B:
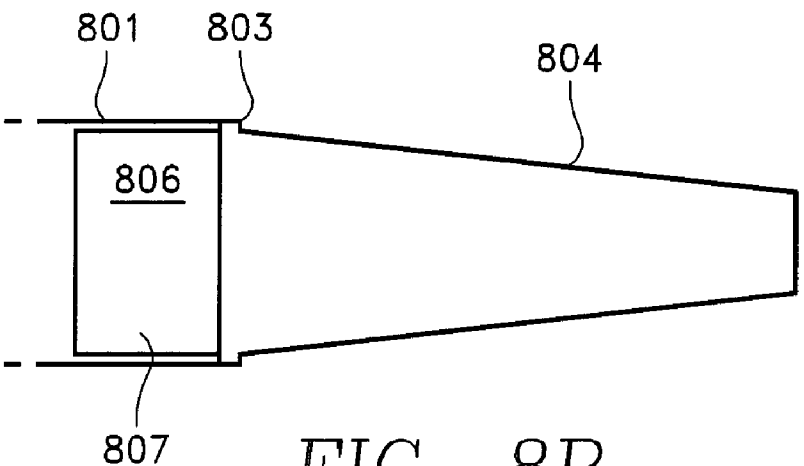
Figure 8C:
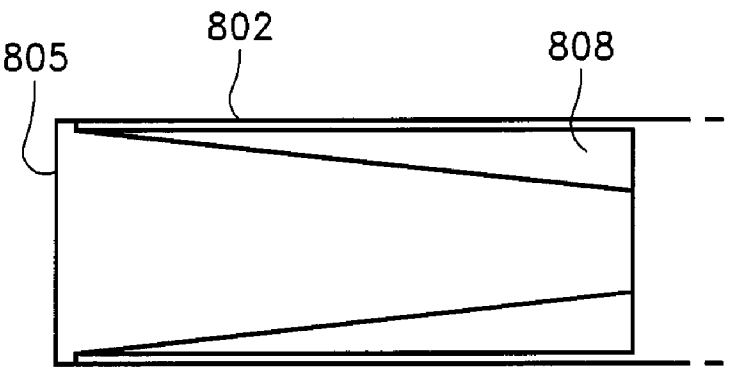

FIGS. 8A-C show an embodiment of ferrules used in the invention for joining track sections. FIG. 8A shows a male ferrule inserted in a female ferrule. FIG. 8B shows a male ferrule fitted to a rail tube. FIG. 8C shows a female ferrule fitted to a rail tube.

Rail tubes 801 and 802 of a track section are shown. Rail tube 801 includes a male ferrule 806 mounted on its end. The male ferrule 806 comprises a cap 803, plug 807 and shaft 804. The cap 803 includes a rim on its edge that has an outer diameter coincident with the outer diameter of the rail tube 801. The plug 807 is sized such that it can be mounted within the diameter of the rail tube 801. In one embodiment the ferrule 806 is coupled to the shaft by bonding it to the shaft, such as by using adhesives. In one embodiment, the male ferrule shaft 804 is tapered for ease of insertion into the female ferrule 808, shown mounted within rail 802. The female ferrule comprises an inverted tapered cone shape for receiving the tapered shaft 804 of the male ferrule 806. In various embodiments, the male and female ferrules have external threads for engaging a threaded insert or part of the rail tube.

In operation the shaft 804 of the male ferrule 806 is inserted into a female ferrule opening 805 and ultimately into the tapered opening of female ferrule 808 of rail tube 802. As can be seen, by having the female ferrule 808 including a tapered opening, the shaft 804 of male ferrule 806 can have full contact with the female ferrule 808, improving strength of the assembled ferrule joint.

Use of ferrules 806, 808 provides a joint connecting rail tubes that is substantially continuous, with no gaps or raised areas. This is because the rail tube is joined in a substantially aligned and face to face relationship with a corresponding rail tube. When the dolly wheels roll over the joint, it's substantially seamless design reduces vibration and sound introduced by dolly/track and dolly/joint interactions, providing, inter alia, a smooth travel surface along all joined sections.

In some embodiments, the shaft 804 of the ferrule 806 is sized so as to provide a relatively tight fit within the opening 805 of a rail tube. This provides a strong joint enabling, for example, carrying joined sections of track while maintaining aligned rail tube joints and limiting the bending of joined track sections.

In one embodiment of the invention, the tube is comprised of a hybrid composite of fiberglass and carbon fiber. The material may be worked by pull-trusion or any other suitable means of forming hollow tubes. After initial forming, the ferrules can be placed in the tube such as by adhesive or any other suitable coupling means. The entire tube and ferrule assembly can then be further machined together to the tolerances desired. By doing this processing step in this manner, the problems of machining or producing separate pieces to exact tolerances is minimized and avoided.

Figure 9B:
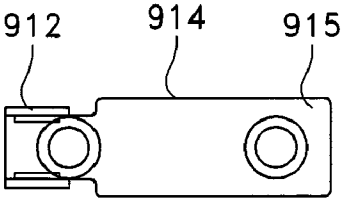
FIGS. 9A-E are views of a buckle for use with the track section of FIG. 1.
Figure 9C:
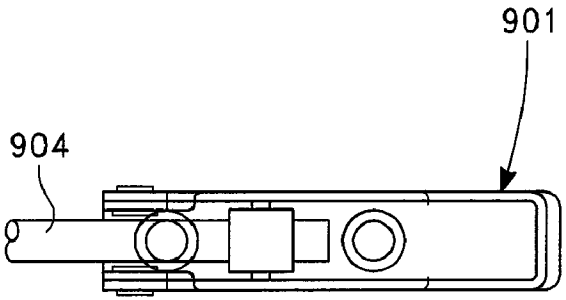
Figure 9D:
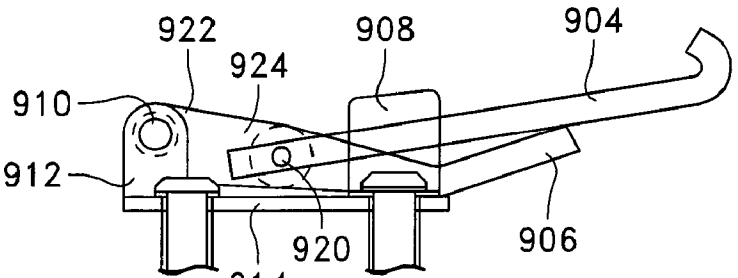
Figure 9E:
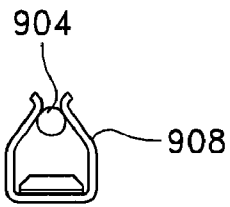
Figure 9A:
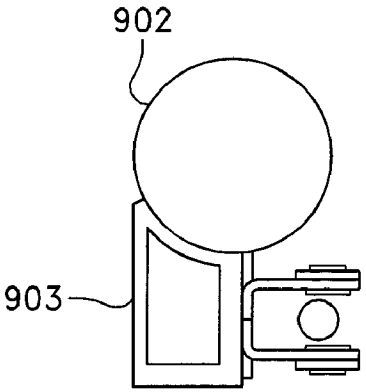

FIGS. 9A-E show an embodiment of a buckle for joining track sections. In particular, FIG. 9A shows an end view of a mounted buckle, FIG. 9B shows a buckle base, FIG. 9C shows a buckle top view, FIG. 9D shows a buckle side view, and FIG. 9E shows a buckle end view.

The buckle includes a clevis part 912 at a first end of a lever base 914. A lever 906 has a connecting end 922 rotatably engaging the clevis at a first pinned connection 910. Rotatably mounted to the lever near its midsection 924 is an arm 904. In various embodiments, the arm is in the form of a latch or a pawl (hereinafter "pawl") and it is mounted to the lever via a second pinned connection 920. Opposite the lever's connecting end is a lever distal end 906 for grasping and actuating the lever. A fastener for holding the pawl 908 is located near a second end of the lever base 915. The buckle therefore includes a clevis, a lever, a pawl, and a fastener wherein the lever is rotatably engaged with the clevis, the pawl is rotatably engaged with the lever and the pawl is operable to restrain the lever when a midsection of the pawl 907 is captured by the fastener.

In this embodiment, the buckle 901 is mounted sideways on the support member 903 which supports a rail tube 902. As shown in FIG. 1, there is a similar open section at a terminal end of the inner portion of the support member capable of receiving a buckle 901. A pin, post, fixture, slot or similar mating fastener on an opposed track section interconnects with a pawl 904 of a buckle. A lever such as a cam lever 906 is operable to tighten the buckle and pull the two track sections together.

Figure 10:
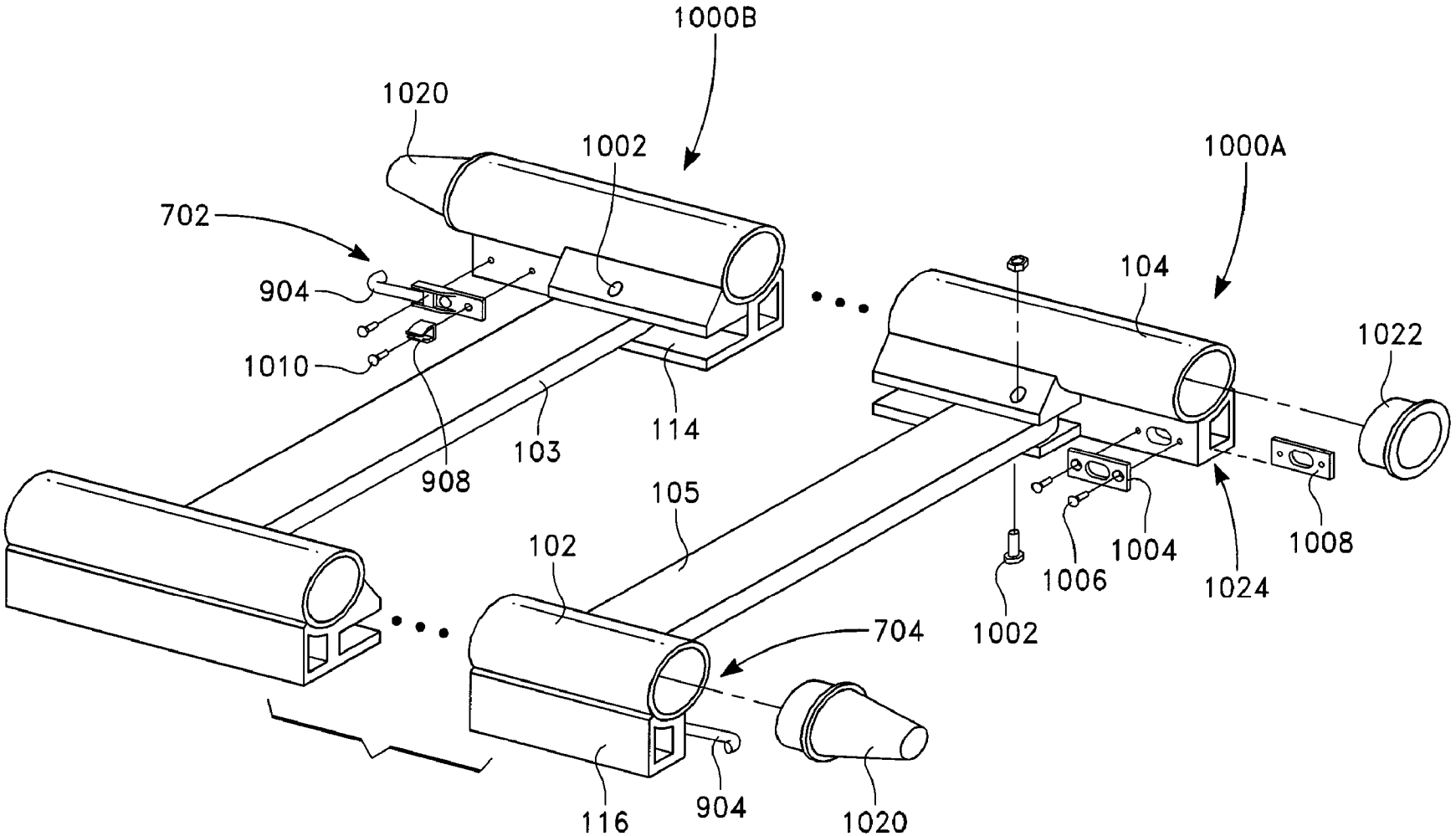
FIG. 10 is a perspective view of an embodiment of the track section of FIG. 1.

FIG. 10 shows opposing ends of a track section in accordance with the present invention 1000A, 1000B. Rail tubes 102, 104 are spaced apart by articulating cross members 103, 105. Rotatable couplings 1002 interconnect rail tube supports 114, 116 and opposing ends of each cross member. Male and female ferrules 1020, 1022 are fixed to the ends of the rail tubes such that adjoining track sections position male ferrules opposite female ferrules. Means for holding adjacent track sections together includes buckles 702, 704 fixed near the ends of the rail tubes to the rail tube supports 114, 116 and pockets and/or latch plates 1004 fixed near the ends of opposing rail tube sections. In some embodiments, latch plates are coupled to a hollow section of the rail tube support 1024 such that latch plate screws or fasteners 1006 pass through the latch plate and through the hollow wall and interconnect with a latch backing plate 1008, for example using a threaded connection. And, in some embodiments a pawl fastener 908 is secured to the hollow part via a screw or fastener 1010.

While various embodiments of the present invention have been described above, it should be understood that they are presented by way of example only, and not limitation. Skilled artisans will recognize various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A method of providing a smooth, low noise dolly movement comprising the steps of:

providing first and second track sections, each section including first and second hollow rails;

providing for each rail a respective support member including a hollow part and opposed flanges;

continuously and eccentrically supporting each rail with the hollow part;

spacing the support members apart with a plurality of cross members, each cross member having opposed ends and each end rotatably coupled between the opposed flanges of one of the rail support members;

providing a male conical ferrule at one end of each rail and a female conical ferrule at the opposite end of each rail, rail ends at an end of the same track section having one male ferrule and one female ferrule;

providing adjacent to each mated ferrule pair a buckle with a lever operated latch and a slotted latch plate affixed to the hollow part;

mating the male and female ferrules at one end of the first track section with the female and male ferrules at one end of the second track section;

drawing the mated ferrules together by hooking the latch in the slotted latch plate and rotating the lever to close the buckle;

limiting dolly bumps by matching a rail outer diameter with a ferrule outer diameter where the rail abuts the ferrule; and, limiting dolly noise by selecting a rail material and a mating dolly wheel material that produce a lubricious wear byproduct during use.

2. The method of claim 1 further comprising the step of providing each said rail as an uncoated carbon fiber composite rail and wherein the lubricious wear byproduct is a material containing carbon.

3. The method of claim 2 further comprising the step of:

providing access to a cavity of the hollow part via the latch plate slot; and, wherein interengaging the latch and the slotted latch plate results in the latch protruding into a hollow part cavity.

4. A track assembly comprising:

first and second hollow rail tubes coupled to respective support members and at least one cross member interconnecting the support members;

each support member including a hollow part and two flanges;

the hollow part extending along the length of a respective one of said rail tubes;

the flanges extending along a majority of the length of the respective rail tube;

the hollow part including a first side formed to match a curvature of a selected outer circumference of the rail tube;

the first side of the hollow part supporting the rail tube;

the hollow part including a second side, the flanges extending from the second side with a gap therebetween;

the hollow part including a third side for supporting the rail tube;

the cross member having opposed ends and an end of the cross member having an uncurved corner substantially opposite a curved corner;

the cross member end inserted in the gap of one of said support members and rotatably coupled to the flanges forming the gap;

the track having collapsed and extended states;

in the extended state, the cross member extends between the support members with the cross member ends located in the gaps; and, in the extended state, the uncurved corner limits rotation of the cross member with respect to a respective one of the support members in one direction.

5. The track assembly of claim 4, wherein in the collapsed state a lengthwise edge of one of the cross members is located mostly between the flanges of a respective one of the support members.

6. The track assembly of claim 4, wherein in the collapsed state an end of a respective one of the cross members is mostly located in a pocket created by opposing flanges of adjacent ones of the support members.

7. The track assembly of claim 4, further comprising: a rail tube circumference about evenly divisible into four consecutive quadrants, the first quadrant meeting the fourth quadrant at a top of the rail tube for supporting dolly wheels; and, wherein the selected outer circumference of one rail tube is substantially included in the third quadrant of the rail tube circumference.

8. The track assembly of claim 7, further comprising: a fourth side of the hollow part; and, wherein the second and fourth sides of the hollow part support the rail tube.

9. The track assembly of claim 8 further including:

a buckle for drawing adjacent track assemblies together;

the buckle including clevis, a lever, a pawl, and a fastener;

the lever rotatably engaged with the clevis;

the pawl rotatably engaged with the lever; and, the pawl operable to restrain the lever when a midsection of the pawl is held by the fastener.

10. A track assembly comprising:

first and second self-lubricating, hollow rail tubes coupled to respective support members and at least one articulated cross member interconnecting the support members;

each support member including a hollow part and two flanges;

the hollow part including a first side formed to match a curvature of a selected outer circumference of a respective one of the rail tubes;

the first side of the hollow part supporting the rail tube;

the hollow part including a second side, the flanges extending from the second side with a gap therebetween;

the hollow part including a third side for supporting the rail tube;

the cross member having opposed ends; an end of the cross member having an uncurved corner substantially opposite a curved corner;

the cross member end inserted in the gap of a respective one of the support members and rotatably coupled to the flanges forming the gap;

the track assembly having collapsed and extended states;

in the extended state, the cross member extends between the support members with only the cross member ends located in the gaps; and, in the extended state, the uncurved corner limits rotation of the cross member with respect to a respective one of the support members in one direction.

11. A track assembly comprising:

first and second hollow rails;

first and second support members coupled to the first and second rails to support the first and second rails;

each support member including a hollow part and two opposed flanges;

the hollow part including a first side formed to match the curvature of a selected outer circumference of a respective one of the rails;

the first side of the hollow part supporting the rail;

the hollow part including a second side, the flanges extending from the second side with a gap therebetween;

a cross member having first and second opposed ends, the first end pivotally coupled between the flanges of the first support member and the second end pivotally coupled between the flanges of the second support member;

a first buckle mounted at an end of the first support member for engaging a mating fastener mounted at an end of an opposed support member;

the buckle including a clevis, a lever, a pawl, and a fastener wherein the lever is rotatably engaged with the clevis, the pawl is rotatably engaged with the lever and the pawl is operable to restrain the lever when a midsection of the pawl is captured by the fastener;

the track assembly having collapsed and extended states; and, in the collapsed state an edge of one of the cross member is substantially located in a gap created by opposing flanges of a respective one of the support members.

* * * * *